US007878668B2

(12) United States Patent
Martinez

(10) Patent No.: US 7,878,668 B2
(45) **Date of Patent: *Feb. 1, 2011**

(54) DEPLOYABLE EMERGENCY LIGHTING SYSTEM

(75) Inventor: Patrick Martinez, Thousand Oaks, CA (US)

(73) Assignee: Emerge Products, LLC, Sherman Oaks, CA (US)

( * ) Notice: Subject to any disclaimer, the term of this patent is extended or adjusted under 35 U.S.C. 154(b) by 309 days.

This patent is subject to a terminal disclaimer.

(21) Appl. No.: 12/050,945

(22) Filed: Mar. 19, 2008

(65) Prior Publication Data

US 2010/0277889 A9 Nov. 4, 2010

Related U.S. Application Data

(63) Continuation-in-part of application No. 12/009,899, filed on Jan. 22, 2008, which is a continuation-in-part of application No. 11/725,793, filed on Mar. 20, 2007, now Pat. No. 7,645,047.

(51) Int. Cl.
*F21V 19/04* (2006.01)

(52) U.S. Cl. ..... 362/20; 362/147; 362/183

(58) Field of Classification Search ..... 362/228, 362/230, 234, 183, 184, 270, 285, 147, 286
See application file for complete search history.

(56) References Cited

U.S. PATENT DOCUMENTS

| | | | | |
|---|---|---|---|---|
| 3,217,156 | A | 11/1965 | Sherwood | |
| 3,324,304 | A * | 6/1967 | Duncan | 307/66 |
| 3,969,720 | A * | 7/1976 | Nishino | 340/815.69 |
| 4,535,391 | A * | 8/1985 | Hsiao | 362/183 |
| 4,617,561 | A | 10/1986 | Brown | |
| 4,802,065 | A * | 1/1989 | Minter et al. | 362/20 |
| 5,446,629 | A * | 8/1995 | Steiger et al. | 362/34 |
| 5,548,494 | A * | 8/1996 | Blackman | 362/183 |
| 5,645,341 | A * | 7/1997 | Liao | 362/183 |
| 5,682,131 | A | 10/1997 | Gow | |
| 6,336,729 | B1 | 1/2002 | Pavelle et al. | |
| 6,527,419 | B1 | 3/2003 | Galli | |
| 7,645,047 | B2 * | 1/2010 | Martinez | 362/20 |
| 2006/0239003 | A1 | 10/2006 | Eisenson | |
| 2008/0232082 | A1 * | 9/2008 | Martinez | 362/20 |

* cited by examiner

*Primary Examiner*—Sandra L O Shea
*Assistant Examiner*—Danielle Allen
(74) *Attorney, Agent, or Firm*—Cislo & Thomas, LLP

(57) ABSTRACT

An emergency lighting system comprising a housing further comprising a flat cover, wherein the flat cover automatically opens during an emergency condition; a removable light source located inside the housing further comprising a rechargeable battery and a wide angle LED light bulb, wherein the removable light source remains off under a normal condition and the light source automatically turns on in response to an emergency condition. The emergency lighting system may further comprise a fixed light source for continuous illumination during an emergency condition. Furthermore, the emergency lighting system may further comprise an electrical outlet for use during normal conditions. The emergency lighting system may be retrofitted into existing outlets or the emergency lighting system may further comprise outlet plugs to plug into an existing outlet.

19 Claims, 16 Drawing Sheets

DEPLOYABLE EMERGENCY LIGHTING SYSTEM

CROSS-REFERENCE TO RELATED APPLICATIONS

This patent application is a continuation-in-part of U.S. patent application Ser. No. 12/009,899, filed Jan. 22, 2008, entitled "Deployable Emergency Lighting System," which is a continuation-in-part of U.S. patent application Ser. No. 11/725,793, entitled "Deployable Emergency Lighting System," filed Mar. 20, 2007, now U.S. Pat. No. 7,645,047, incorporated herein by this reference.

BACKGROUND OF THE INVENTION

1. Technical Field

This invention relates to emergency lights that are deployed during an emergency situation, such as a power failure.

2. Background Art

During a power failure, particularly at night, it is necessary to have some form of battery operated light that is easy to find and easy to access. Most residential home owners rely on flashlights conveniently placed so they would know where to find the flashlight in the dark. However, these common flashlights do not automatically turn on and can be misplaced. In addition, whether the batteries work or not, may not be known until its use, which may be during the emergency. Having emergency lights turn on automatically in response to a power failure is known in the art. Most commercial buildings use surface mounted safety lights that turn on automatically during a power failure. These may provide guidance in which direction to go, but these lights cannot be used like a flashlight by the occupant. "Plug-In" style safety lights have also been used in residential applications. However, these "Plug-In" styles may not be aesthetically pleasing. In addition, "Plug-In" style lights require the use of an outlet, thereby, reducing the number of outlets available for other uses. Also, a light switch that "glows" in the dark has been recently patented. However, this device cannot be used like a flashlight. Therefore, there is a need for an emergency lighting system that automatically deploys during an emergency situation, such as a power failure, that provides guidance in which direction to go and that is removable so as to be taken by the occupant to use as a flashlight. Furthermore, the device needs to be rechargeable when power is available so that battery power is always available during the emergency.

BRIEF SUMMARY OF INVENTION

The present invention is directed to an emergency lighting system designed to automatically deploy during an emergency condition, such as a power outage. The device is a module that could be installed in a standard single gang device enclosure. In the "off" position it is a flat blank cover that could blend in with the wall and not be noticed. When it is in this position it would also be using the approximately 110V to approximately 250V AC supplied by the mains power to charge the batteries located inside the light. When the power to the building is lost, the front cover acts as a trap door to allow the light to angle out from the wall. The light would then turn on and illuminate the area above it. It would act as an emergency light to allow people to easily find their way out of the building or home. The light portion will also be removable so that someone can pull it out of the module and use it as a flashlight.

DETAILED DESCRIPTION OF THE INVENTION

Figure 1:
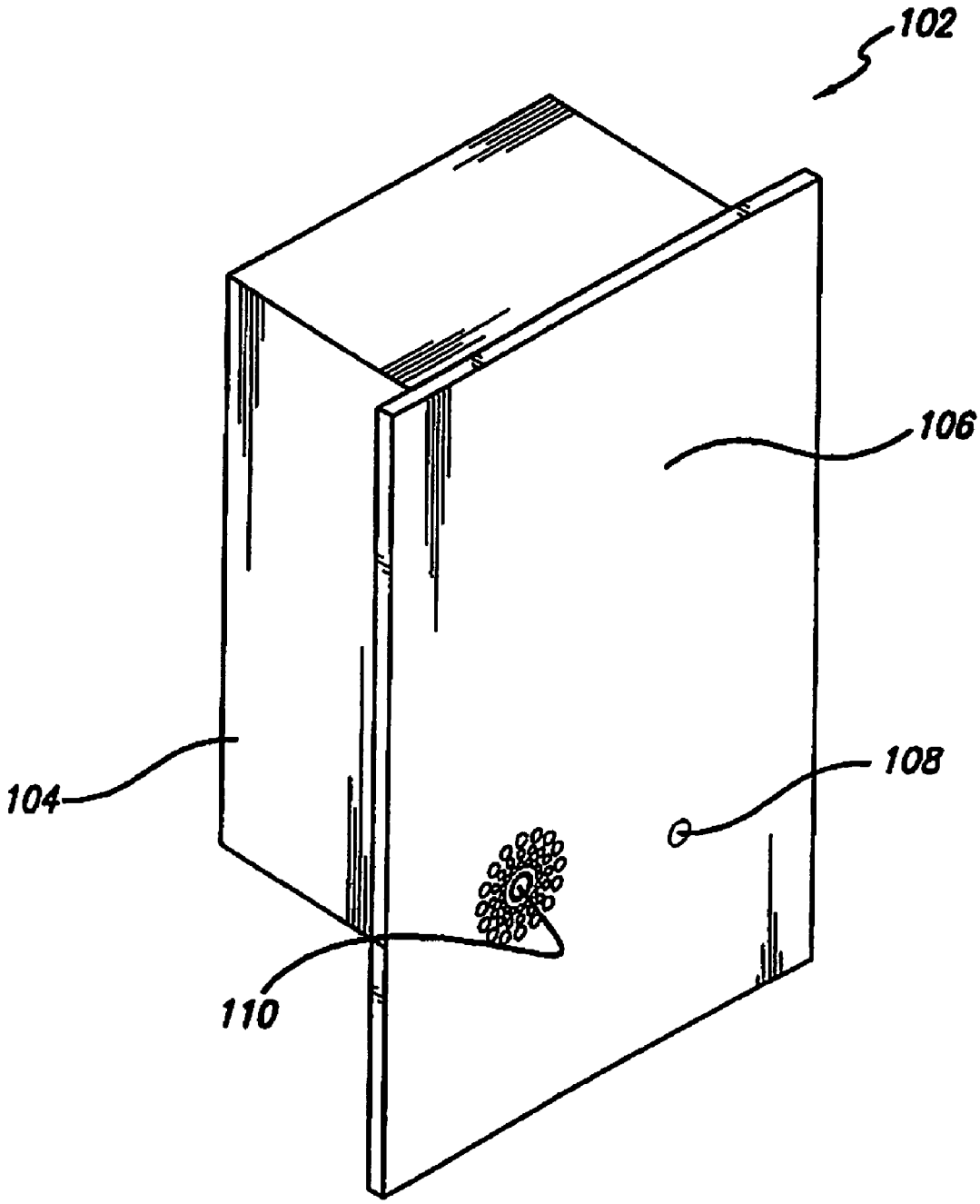
FIG. 1 is a perspective view of an embodiment of the current invention.

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

The present invention is an emergency lighting system 102 comprising a housing 104, a cover 106 attached to the housing 104, and a light source 202 located inside the housing 104 during normal conditions, the light source 202 comprising at least one power source 700, wherein the light source 202 remains off under normal conditions and the light source 202 automatically turns on in an emergency situation and can be removed from the housing 104. For example, under the normal condition, such as when there is power to a building or a home, the light source 202 remains off and the power source 700, such as a rechargeable battery, would be charged by the mains power. Under an emergency condition, such as when there is power failure, the cover 106 would open like a trap door and the light source 202 would turn on and angle out from the wall, thereby providing lighting to an area or pathway for a safe exit. This would allow the occupant of the premises to see the light, walk towards the light, remove the light source 202 from the housing 104, and use it as a flashlight.

As shown in FIG. 1, the device is a module that would be installed in a standard single gang device enclosure. Generally the housing 104 would be a small container about the size of a standard outlet or light switch, suitable for holding a small light source 202, such as a flashlight. The housing 104 may further comprise mounts 212 to secure the housing 104 to the wall.

Figure 13:
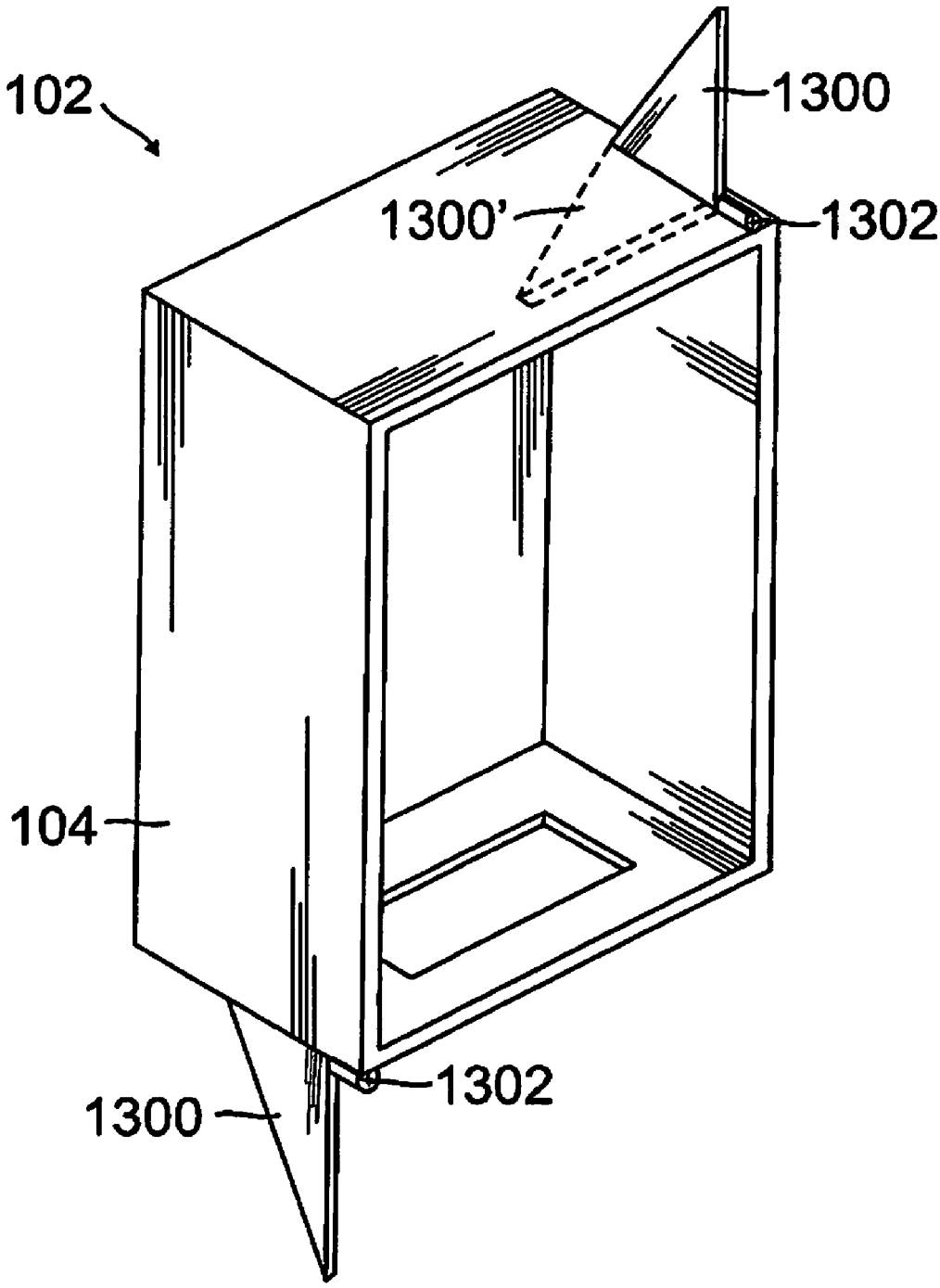
FIG. 13 is perspective view of another embodiment of the current invention with the cover removed for clarity only.

In some embodiments, the housing 104 may comprise mounting wings 1300 for quicker retrofitting installation as shown in FIG. 13. The mounting wings 1300 may be pivotably mounted on the housing 104, for example on the top and on the bottom. To install the housing 104 the mounting wings 1300 are placed in a first position in which the mounting wings lay flat on the housing 104. Once the housing 104 has been inserted into the wall, the mounting wings 1300 may be pivoted upwards with for example, a screw 1302, so as to project out from the top or bottom of the housing 104. The mounting wings 1300 may then be secured to the wall.

Alternatively, a separate space in the wall can be created for mounting the emergency lighting system 102 with its separate wiring so that existing outlets will not be eliminated.

Figure 2A:
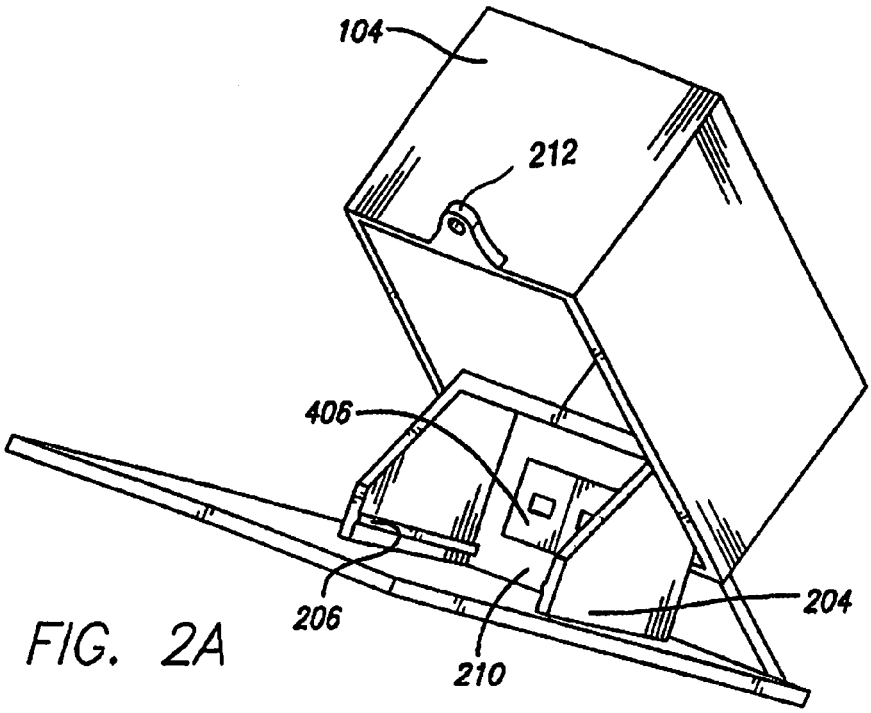
FIG. 2A is a perspective view of an embodiment of the current invention in a deployed position.
Figure 2B:
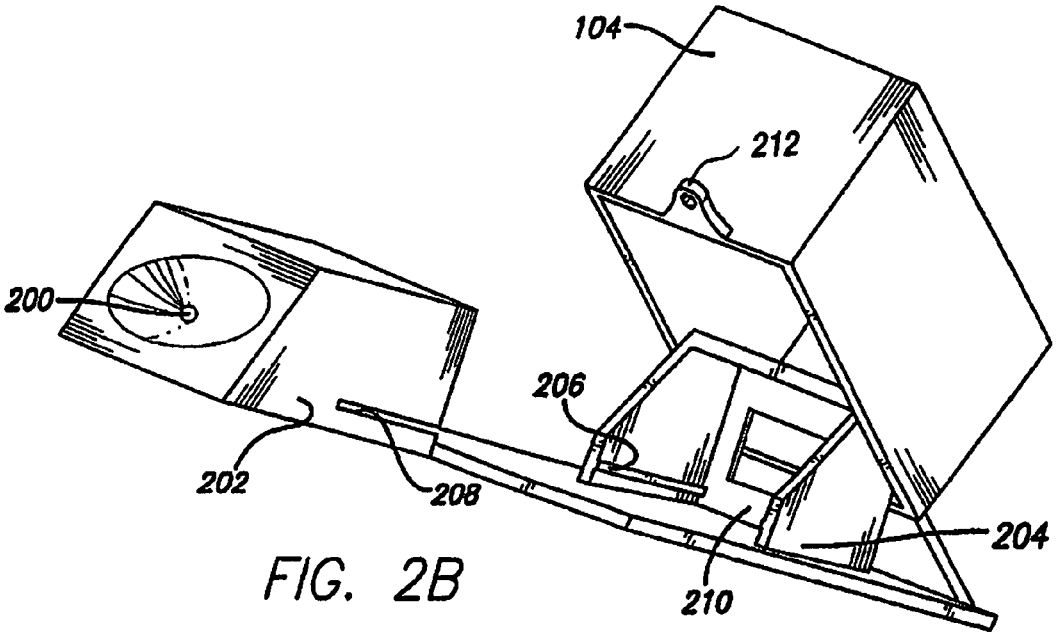
FIG. 2B is a perspective view of another embodiment of the current invention in a deployed position.
Figure 3:
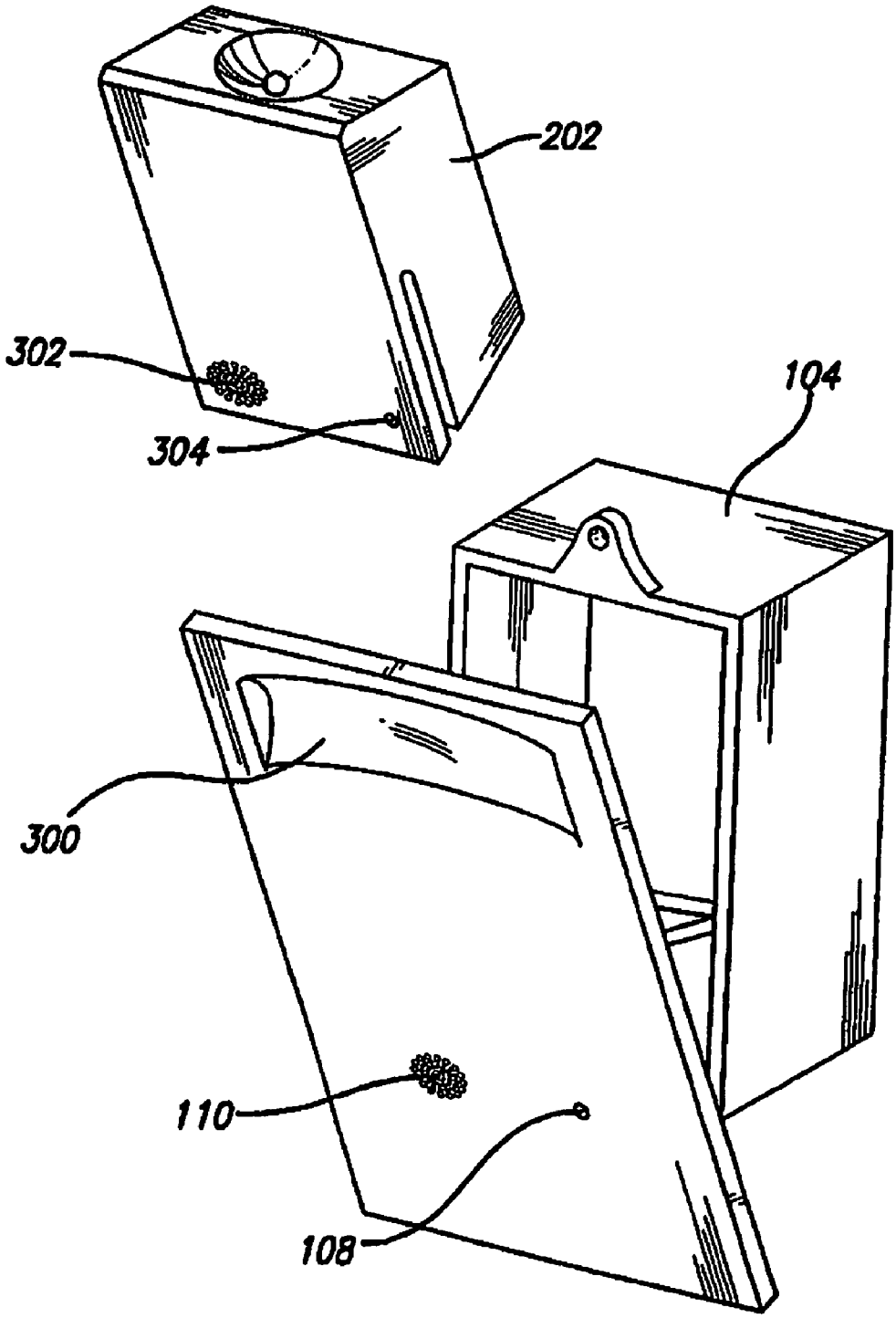
FIG. 3 is a perspective view of another embodiment of the current invention.

A cover 106 can be attached to the housing 104 that would hide the contents inside the housing 104. The cover 106 can be flat and blend in with the wall, thereby making the emergency lighting system inconspicuous. As such, the cover 106 can be painted or covered by wall paper, with appropriate slits along the edges to allow the cover 106 to open. This would hide the light source 202 so that it cannot be seen under normal conditions. However, the cover 106 can be any shape that is aesthetically pleasing or artistic in nature. It is preferable that the housing 104 be mounted in the wall; however, the housing 104 can be mounted on the ceiling, in the floor, or any other location that can be seen in plain view when deployed. As shown in FIGS. 2 and 3, the cover 106 of the housing 104 can further function as a door, such that the cover 106 can be opened during or in response to an emergency condition, such as a power failure, and the light source 202 can be removed.

An occupant should be able to open or detach the cover 106 from the housing 104 quickly and easily. For example, as shown in FIGS. 4-6, the cover 106 can be attached to the housing 104 by a latch system, a magnet, a resistance, a swiveling lock, a door knob-type mechanism, or any other mechanism that allows the cover to be opened immediately and without the assistance of other tools. There are a number of ways for opening covers. For example, the cover 106 can swing open to the left, to the right, up or down on a hinge. Alternatively, the cover 106 can slide to the left, to the right, up or down, or even straight out perpendicular to the wall like a drawer. In some embodiments, rather than being arranged vertically and opening from the top, the emergency lighting system 102 may be arranged horizontally and open from the side. Regardless of the orientation or arrangement of the emergency lighting system 102, when deployed the light should shine out in such a manner as to be visible from any natural view. Thus, reflectors may be added inside the housing to facilitate illuminating a region that can be seen from any vantage point, such as directing the light upwards. The cover 106 can also use gear mechanisms alone or in combination with the aforementioned mechanisms.

As shown in FIG. 4, in a preferred embodiment, the cover 106 is connected to the housing 104 by a hinge 400. Preferably the hinge 400 is at a bottom, outer edge of the housing 104 with the light source 202 sitting upright in the housing 104, such that during an emergency condition, such as a power failure, the cover 106 can open by swinging outward and downward on the hinge 400. As shown in FIGS. 2A and 2B, the cover 106 can further comprise a support 204 where the light source 202 can be mounted. The support 204 can further comprise a tongue 206 and the light source 202 can further comprise a groove 208, such that the groove 208 fits into the tongue 206 to secure the light source 202 in the support 204. This allows the light source to be quickly and easily removed during an emergency situation and replaced when normal conditions are returned. The support 204 can further comprise a floor 210, wherein the floor further comprises a battery recharging base 406. In another embodiment, the floor 210 comprises a hole and the battery recharging base 406 is located on the housing 104 such that in the closed position the battery charging terminals 800 can make contact with the battery recharging base 406 through the hole of the floor 210 as shown in FIG. 5B.

Under normal conditions, the light source 202 is hidden in the housing 104. Preferably, the light source 202 is mounted onto the cover 106. When the emergency lighting system deploys the cover 106 detaches from the housing 104 and tilts out such that when the light source 202 is turned on in response to the emergency condition or due to the opening of the cover 106, the light will shine out from the wall at an angle. This would be plainly visible to anybody in the vicinity. The light source is not fixed to the housing or the cover by electrical wires so that in the deployed configuration the light source 202 can be removed quickly, easily, or instantly without the use of any tools, carried away, and used completely free from the housing 104 as shown in FIG. 2B.

In some embodiments, the light source 202 can sit in the housing 104 on its side facing outward perpendicular to the wall. During an emergency condition, the cover 106 of the housing 104 can simply swing, flip, or slide open such that when the light source 202 is turned on the light can be seen shining perpendicularly outward from the wall. The light source 202 can also rest on a support 204 movably coupled to the housing 104 such that the support 204 can be automatically ejected out of the housing 104 when the cover 106 is opened. The support 204 can slide out, roll out, fall out, be pushed out, be pulled out or be ejected in a number of different ways.

Similar mechanisms can be employed for detaching or opening the cover 106 of the housing 104 regardless of whether the housing 104 is mounted on the wall, the floor, the ceiling, or any other convenient location. However, if the housing 104 is mounted on the ceiling, the light source 202 would have to be attached to the housing 104 or the ceiling by a string, a rope, a strap, a chain, or the like so as to dangle far enough towards the ground for an occupant to reach the light source 202 and easily remove the light source 202 from its connection. This will prevent the light source 202 from falling to the ground while still providing light that can be seen in plain view.

Figure 4A:
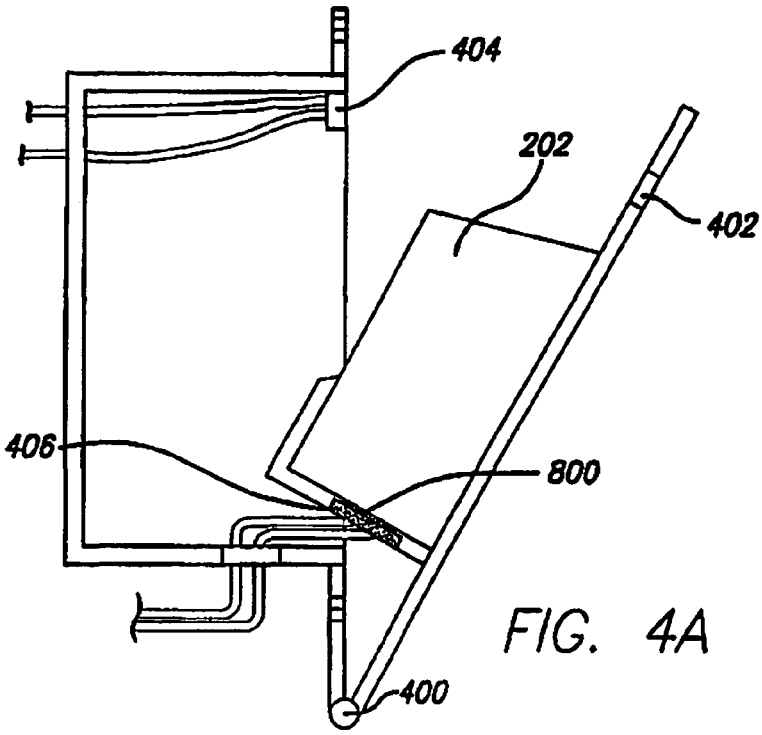
FIG. 4A is a side view of an embodiment of the current invention in the deployed position with one side wall removed for clarity only.
Figure 4B:
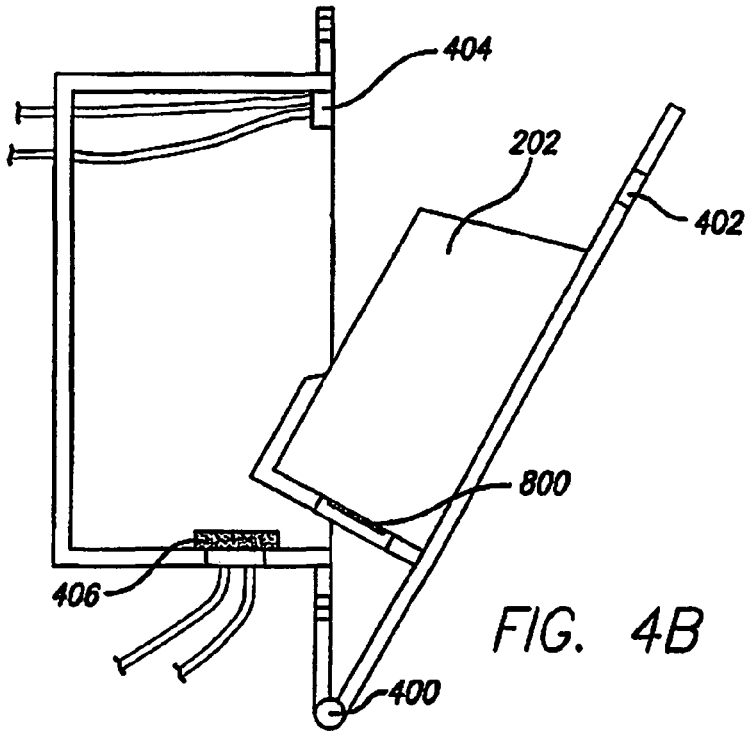
FIG. 4B is a side view of another embodiment of the current invention in the deployed position with one side wall removed for clarity only.

In some embodiments, as shown in FIGS. 4A and 4B, the emergency lighting system 102 can be wired such that the cover 106 opens automatically or detaches automatically from the housing 104 during a power failure to provide a means for accessing the light source 202. The cover 106 opening or detaching automatically during an emergency situation, such as a power failure, provides a means for transmitting light to allow an occupant to see in which direction to go. There are numerous mechanisms for allowing a cover to open automatically during a power failure. For example, the cover 106 can comprise a hinge 400 at the bottom that naturally would keep the cover 106 in the open position by a spring. Alternatively, the cover 106 can have gears, hinges, slides, or any other mechanism that provides a mechanism for opening the cover 106. The cover 106 can have a metal strip 402 with magnetic properties and the housing 104 can have a magnet 404. Alternatively, the metal strip 402 can be on the housing 104 and the magnet 404 on the cover 106. In another embodiment, the cover 106 and the housing 104 can both have magnets 404 of opposite polarity. The magnet 404 can be an electromagnet powered by the mains power from a standard outlet next to the housing 104. During a power failure, the electric current to the electromagnet 404 would be terminated, turning the electromagnet 404 off. This would release the connection between the cover 106 and the housing 104 and cause the spring hinge 400 to force the cover 106 open.

Figure 9:
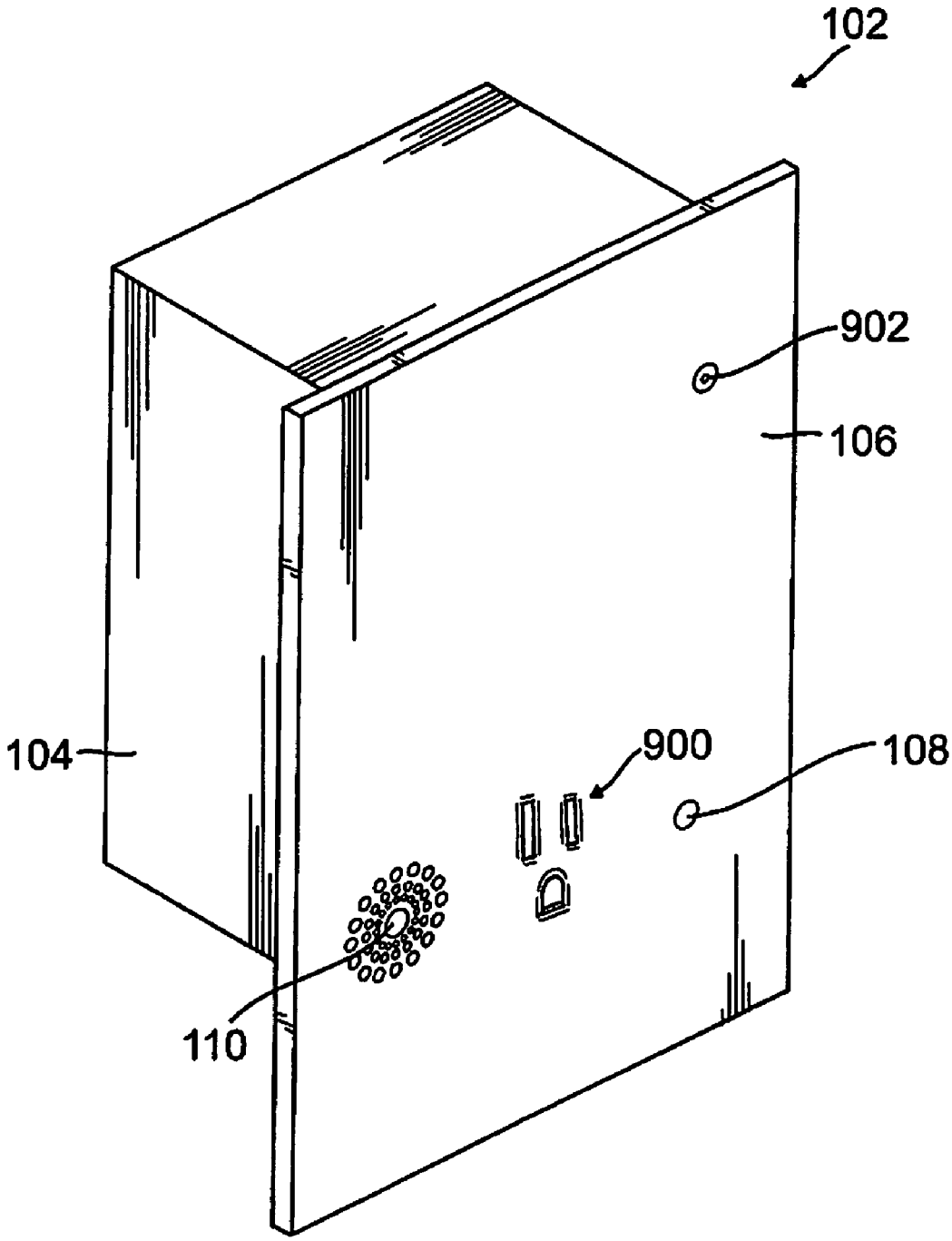
FIG. 9 is a perspective view of another embodiment of the current invention.
Figure 10:
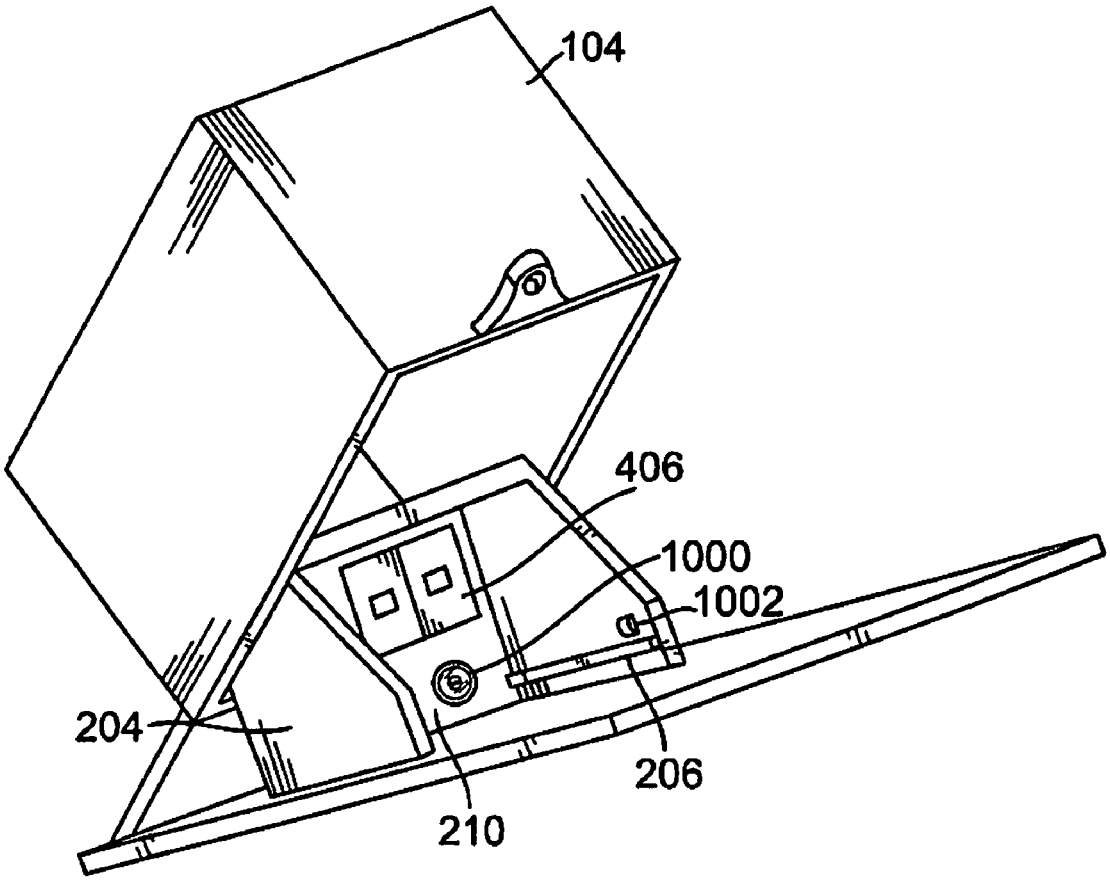
FIG. 10 is a perspective view of another embodiment of the current invention in the deployed position.

In some embodiments with automatic deployment, the emergency lighting system 102 may comprise additional features to prevent unnecessary deployment of the emergency lighting system. For example, deployment may be disabled if there is sufficient ambient light. As shown in FIG. 9, the emergency lighting system 102 may further comprise a light sensor 902, for example, on the cover 106, that can detect the presence of light. If sufficient light activates the light sensor 902, the light sensor 902 can deactivate the deployment. Conversely, when the light sensor is deactivated, in other words it no longer detects ambient light, the deployment of the emergency lighting system is activated. For example, if during daylight hours, there is a power failure, then there would not be a need to deploy the emergency lighting system 102. Therefore, the light sensor 902 would be activated by the ambient light and the emergency lighting system 102 would be deactivated by the light sensor 902. On the other hand, if there is insufficient ambient light, such as at night or when the residence is filled with smoke, deploying the emergency lighting system 102 would be beneficial to facilitate escape. Therefore, the light sensor would be deactivated and the emergency lighting system would be activated.

The emergency lighting system may also delay deployment. For example, during very brief power outages or power flickers when the power is disabled for a few seconds, it would not be necessary to deploy the emergency lighting system 102. The circuitry could be designed with sufficient capacitors to power the emergency lighting system 102 for a brief period of time until the power is restored to prevent deployment when the power is out for only a few seconds. For example, the capacitor may provide between approximately 1 second to approximately 30 seconds of power during a power outage. Generally, most people would not feel uncomfortable sitting in the dark for a few seconds. However, after about 30 seconds or more, people may begin to feel anxious as they wonder whether the light will turn on soon. Preferably, the capacitor provides power for approximately 5 seconds to approximately 15 seconds. However, the delay can be for any amount of reasonable time people are willing to sit in the dark without feeling too anxious.

In some embodiments with automatic deployment, the emergency lighting system 102 may also automatically retract. Thus, if power is interrupted for several minutes and no other danger arises, an occupant may not necessarily wish to remove the light and look for an escape; or while the occupant is heading toward the emergency lighting system 102 the power may be restored, in which case the occupant can return to his normal activity rather than walking throughout the home resetting each emergency lighting system 102.

Once power is restored the emergency lighting system 102 would retract itself using the mains power and turn the light source 202 off so that the system would be ready for the next emergency. In some embodiments, the automatic retraction can be disabled if the light source 202 is not present inside the housing 104 or cover 106. Thus, if the emergency lighting system is still deployed after normal conditions have been restored, the occupant will know that the light source 202 may not have been returned.

The method of retraction may be employed in many different ways. For example, the cover 106 may open and close on gears. The gears may be electrically connected to the mains power. Loss of power releases the gears and allows the door to fall open. Restoration of power can cause the gears to turn and return the cover 106 to its closed position.

In other embodiments, as shown in FIG. 6, the cover 106 can be opened manually or detached manually from the housing 104. For example, the magnet 404 can be a standard magnet. This allows an occupant to quickly and easily detach the cover 106 from the housing 104 so as to provide access to the light source 202 during an emergency condition. The occupant can then reach inside and pull out the light source 202 and use it like a flashlight. Other mechanisms to allow the cover 106 to be quickly and easily detached from the housing 104 or opened include, but are not limited to, latch systems, resistance mechanisms, swivel locks, and door knob-type mechanisms.

The cover 106 can further comprise a means for transmitting light without opening the cover 106. For example, the cover 106 can further comprise a first transparent portion 300. The first transparent portion 300 can be a hole, a window, a clear piece of plastic, glass, or any other material that allows for the transmission of light. The first transparent portion 300 can also be a variety of different colors. Alternatively, the entire cover 106 or any portion of the cover can be transparent or translucent. In embodiments where the cover 106 further comprises a means for transmitting light without opening the cover 106, the cover 106 can be opened manually rather than automatically. Since the light can be transmitted through the cover, the light can still be visible in plain view. The occupant can then walk towards the light and manually open the cover 106 to access the light source. To facilitate manually opening the cover 106, the cover 106 can further comprise a handle 600. In one embodiment the first transparent portion 300 can be concave so as to create a handle 600.

In some embodiments, the emergency lighting system 102 further comprises a means for ejecting the light source 202 out of the housing 104 such that the light source 202 can be easily grasped. This is particularly important for those with large hands who might not be able to reach into the housing 104 and pull out the light source 202. The support 204 can be coupled to the cover 106 by slides, gears, hinges or the like. The opening of the cover 106 could automatically force the support 204 up or out such that the light source 202 protrudes out from the housing 104. This allows the occupant to grasp a portion of the light source 202 without having to stick his/her hands into the housing 104.

In another embodiment, the light source 202 can comprise a protrusion or a strap or any other device located near an opening of the housing such that the protrusion or strap can be grasped by the occupant without having to reach his/her entire hand into the housing.

The light source 202 further comprises a light element 200 such as an incandescent light bulb, light emitting diode ("LED"), LED array, gas discharge lamp (e.g. neon), fluorescent bulb, phosphorous light or any other device that emits light. In a preferred embodiment the light element 200 is a high intensity, wide angle, light emitting diode. LEDs produce high output with very little battery draw and nearly endless life cycle. Also LEDs can be easily focused and dispersed with an adjustable lens. The light source 202 can also be removable from the housing 104 so as to be used as a flashlight.

In addition, the light source 202 can also have an audible alarm 302 as a secondary mechanism to alert an occupant as to the location of the emergency lighting system 102. The audible alarm 302 can be wired so as to turn on during a power failure and be powered by the power source 700. In addition, the audible alarm 302 can function to indicate when the charge of the power source 700 is low so that a user can replace the power source 700 when necessary. The alarm may emit a sound of a single tone, pitch, and volume or the alarm may emit a sound of variable tone, pitch and volume. The alarm may be located on inside the housing, on the cover, on the light source, or any combination thereof.

Figure 7:
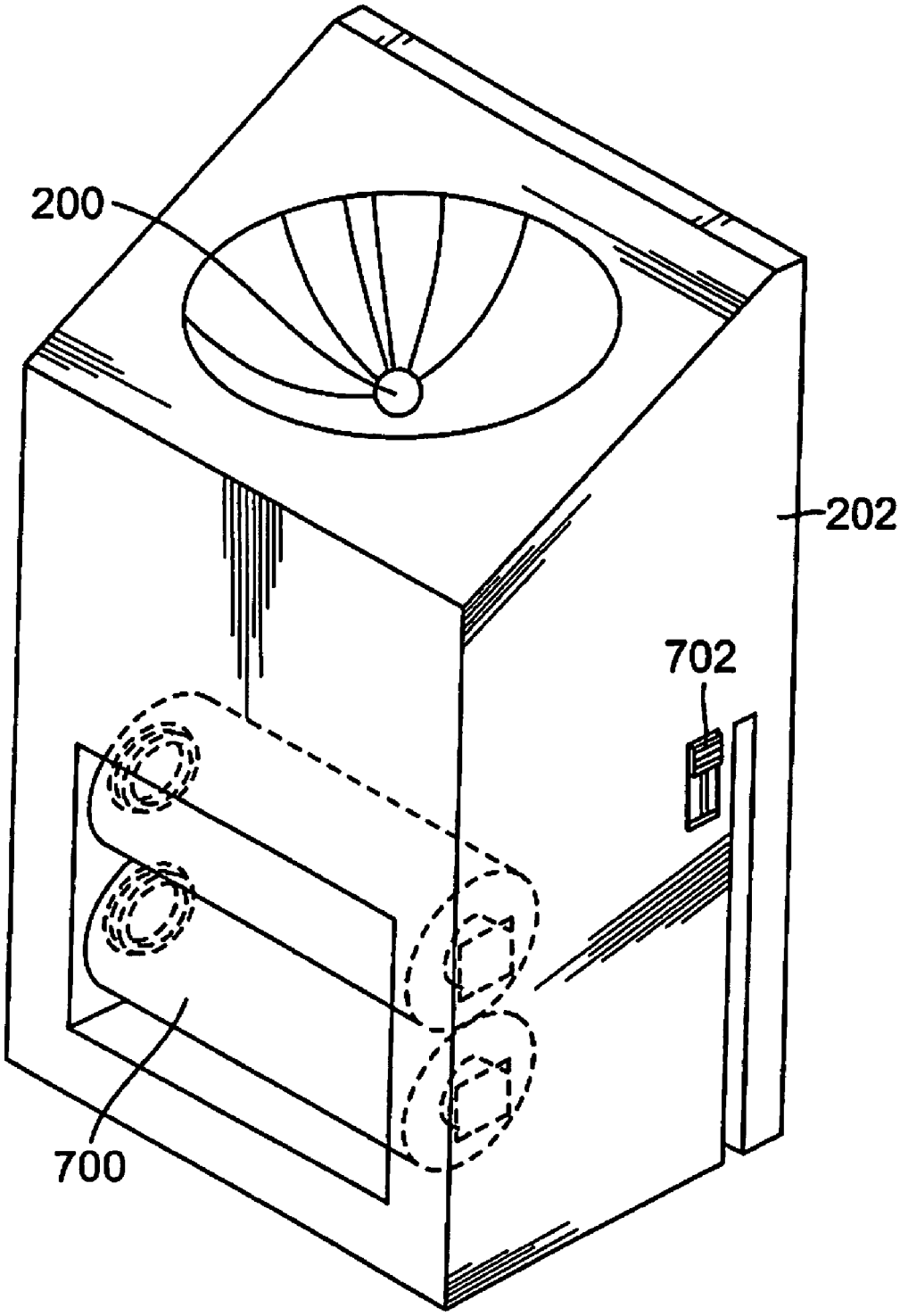
FIG. 7 is a perspective view of a light source of the current invention.
Figure 8:
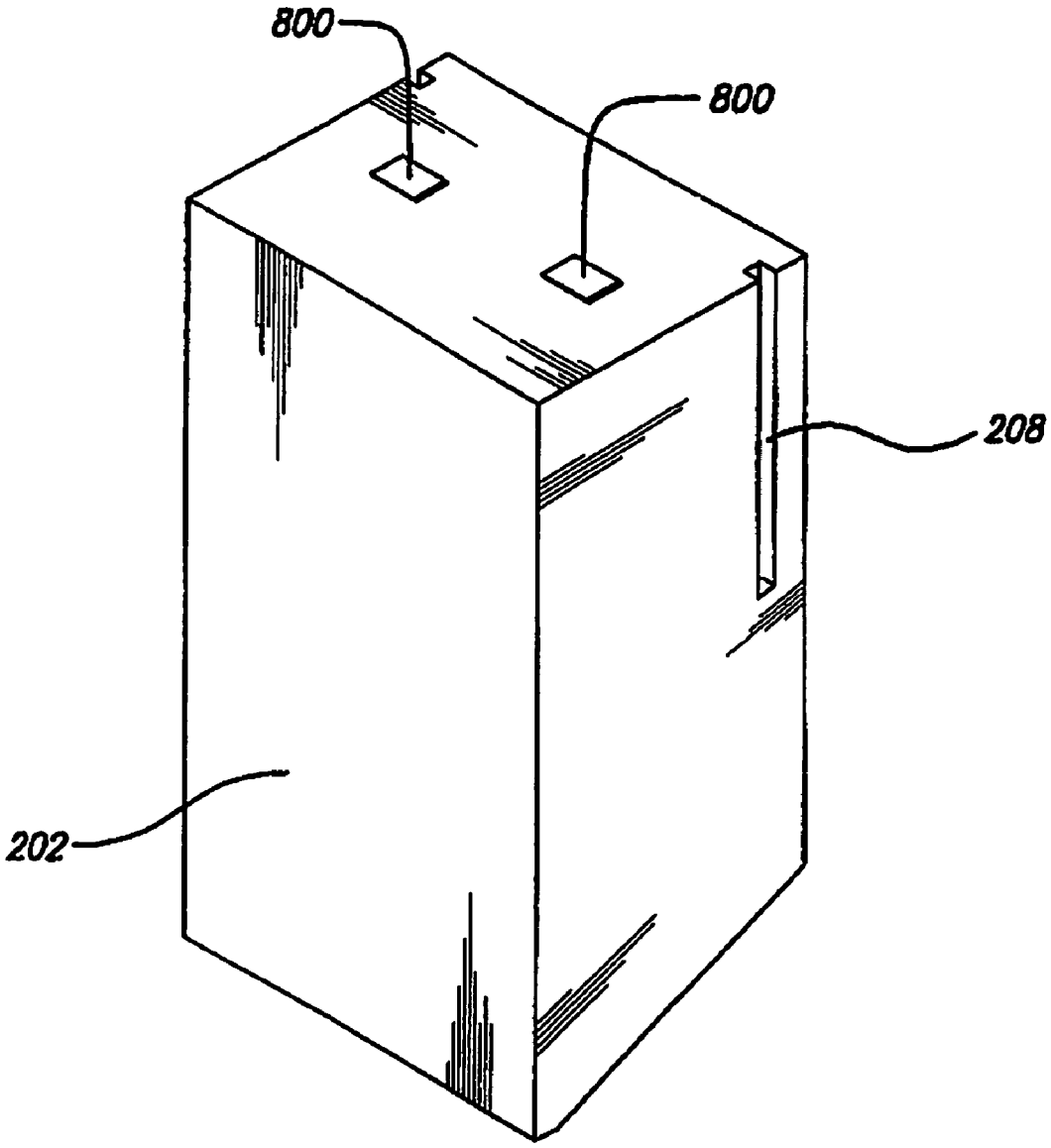
FIG. 8 is a perspective view of the bottom of the light source of the current invention.

The light source 202 can also have a battery light indicator 304 to indicate when the charge in the power source 700 is low. As shown in FIG. 7, the light source 202 may also have a power switch 702 so that the light source 202 can be turned off when not needed so as to save the battery life. The power switch 702 may be on either side of the light source. The switch 702 and the housing 104 or cover 106 may be designed so that the switch 702 must be in the "on" position to dock the unit into the housing 104 or cover 106. For example, the switch 702 may protrude slightly out from the removable light source 202. The housing 104 or cover 106 may have a reciprocal protuberance 1002 at the level of the power switch 702 and on the same side as the power switch 702 such that when the removable light source 202 is completely inserted into the housing 104 or cover 106 the protuberance 1002 of the housing 104 or cover 106 abuts the manual light switch 702 in the "on" position. If the removable light source 202 was inserted into the housing 104 or cover 106 with the manual switch 702 in the "off" position the protuberance 1002 would catch the manual switch 702 exerting a biasing force in the direction of the "on" position. Applying additional force to the removable light source 202 would cause the manual switch 702 to move to the "on" position, thereby allowing the removable light source to be fully inserted into the housing or cover.

Figure 5A:
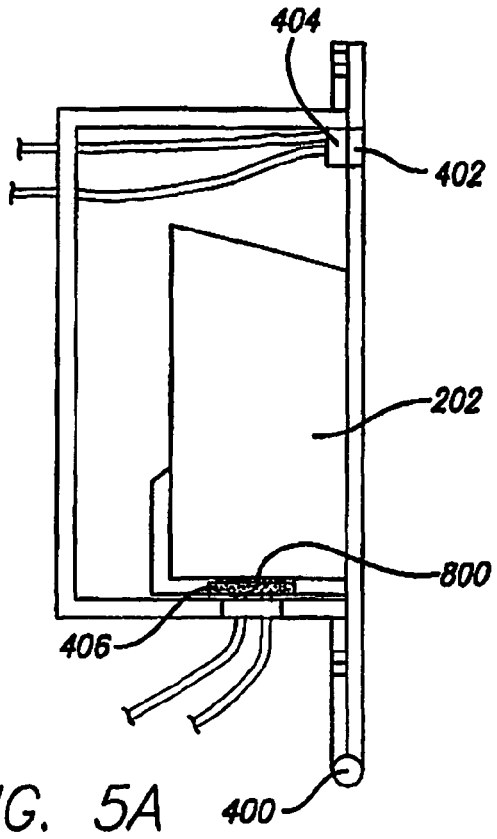
FIG. 5A is a side view of an embodiment of the current invention in the closed position with one side wall removed for clarity only.
Figure 5B:
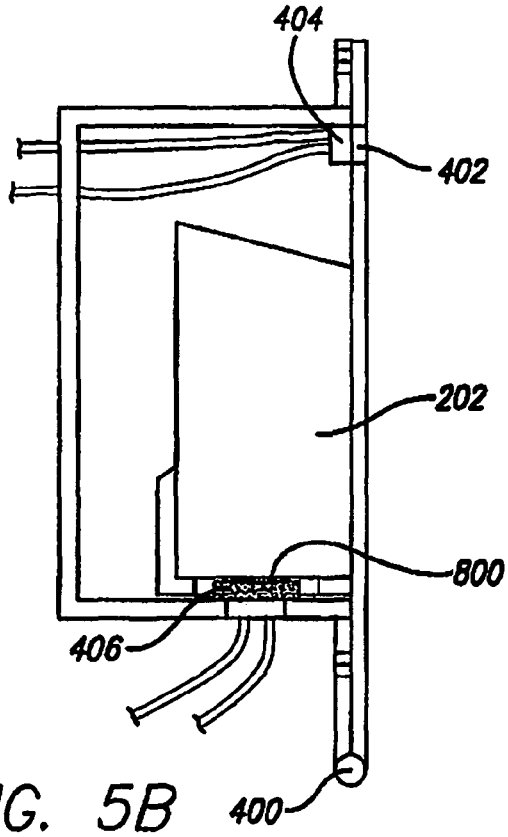
FIG. 5B is a side view of another embodiment of the current invention in the closed position with one side wall removed for clarity only.
Figure 6:
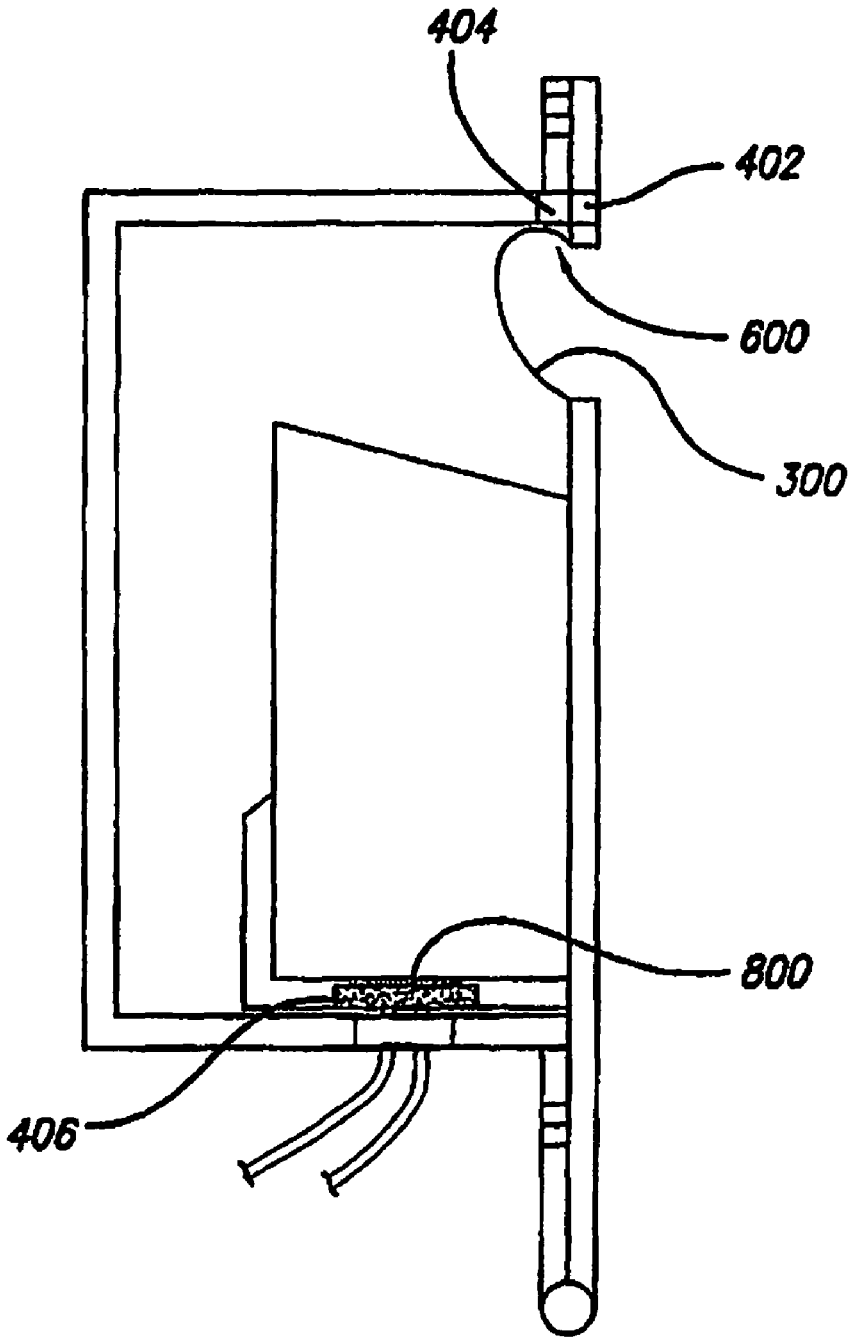
FIG. 6 is a side view of another embodiment of the current invention with one side wall removed for clarity only.

As shown in FIGS. 4A and 5A, the battery recharging base 406 can be incorporated into the floor 210 of the support 204. The battery recharging base 406 can be wired so as to draw its power from the mains power supply so that it can charge the power source 700 of the light source 202 when mains power is available. In addition, the light source 202 can have a charging terminal 800 corresponding to the battery recharging base 406 so as to recharge the power source 700.

The emergency lighting system 102 can be wired such that under normal conditions, for example, when power is available, the light source 202 remains off but in response to emergency situations, such as when power is interrupted the emergency lighting system 102 is deployed, as in FIG. 4A, and the light source 202 automatically turns on and draw its power from the power source 700. When power is restored, whether temporarily or permanently, the light source 202 automatically turns off and the power source 700 can automatically begin recharging again, even without closing the cover 106. Thus, if a subsequent emergency condition arises the power source 700 will have received charge during the interim normal condition. This will assure that the power source 700 will have maximum charge at all times.

In some embodiments, as shown in FIGS. 4B and 5B, the battery recharging base 406 can be incorporated into the housing 104 itself. The support 204 can have a hole on the floor 210 so that the battery recharging base 406 can make contact with the charging terminal 800 of the light source 202. In another embodiment, the floor 210 can serve as a conduit between the battery recharging base 406 and the charging terminal 800.

The power source 700 can be a battery. In a preferred embodiment the battery is a rechargeable battery, such that when mains power is available the battery is charged by the available power supply but during a power failure the battery supplies power to the light source 202. When the power is restored the battery can be re-charged. If a situation arises that interrupts the power to the building temporarily the emergency lighting system 102 would deploy. If the power is restored the lights would turn off and the power source 700 would resume charging so as to be able to supply power if the lights were to be interrupted again. Otherwise, the light source 202 would remain on and the battery power would be exhausted and not be available the next time the power is interrupted.

In some embodiments, the light source 202 or the power source 700 can further comprise a battery life indicator 304 to provide information regarding the amount of power remaining in the battery. The cover 106 of the housing 104 would further comprise a second transparent portion 108 through which the battery life indicator 304 could be perceived. The second transparent portion 108 can be a hole, a window, a plastic, or any other material that allows transmission of light. The second transparent portion 108 can also be a variety of different colors. Alternatively, or concomitantly, the audible alarm 302 can also serve to indicate when a battery requires replacing. The cover 106 can have a perforation 110 so as to provide a means of transmitting the audible signal.

The emergency light can be retro-fitted into an existing outlet by removing the existing outlet and replacing it with the emergency lighting system 102. Alternatively, a new single gang "old work" box could be installed next to an existing outlet and mains power could be taken from the existing outlet to charge the power source 700 and electromagnet 404. This would prevent the occupant from losing the use of an outlet.

Figure 14:
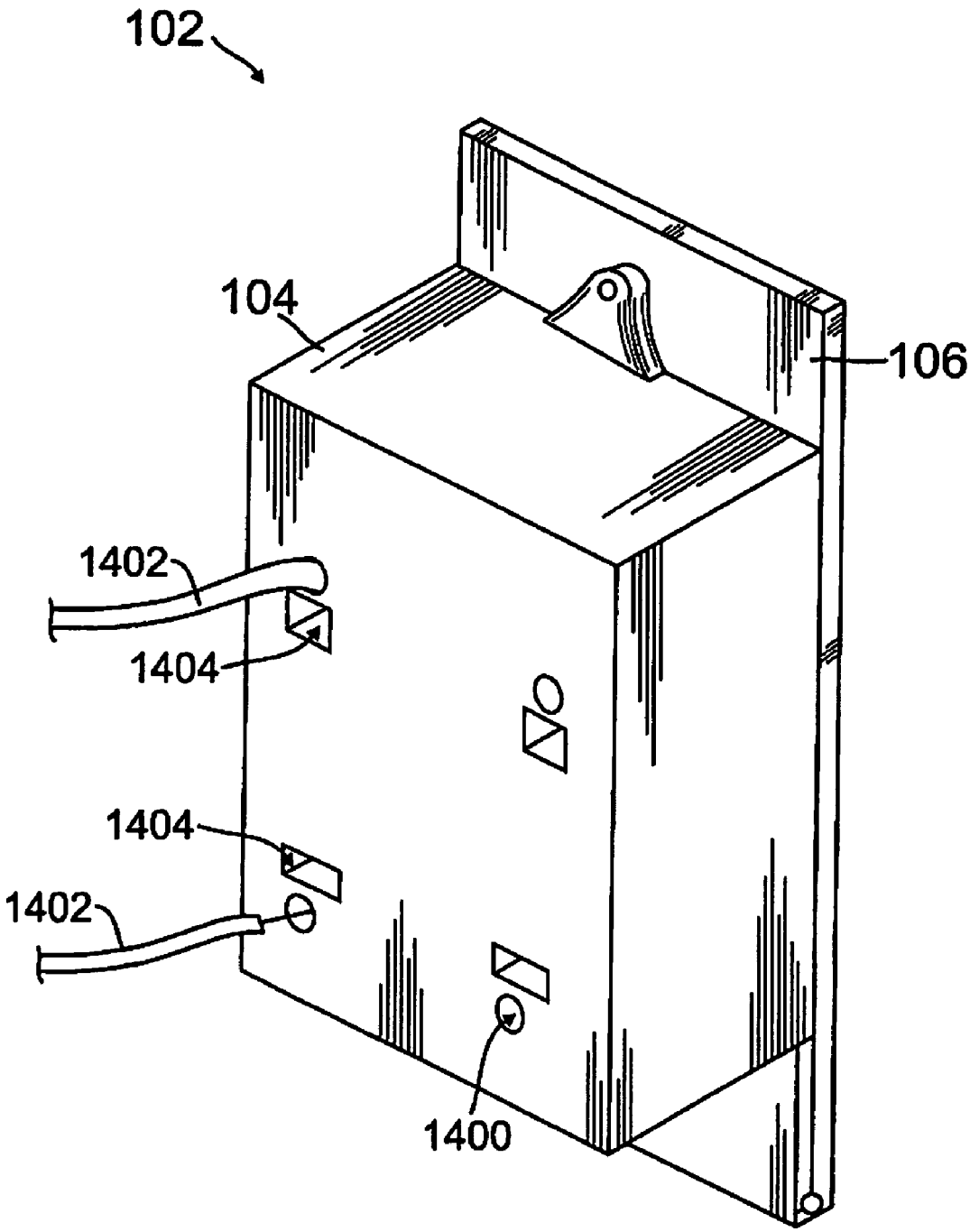
FIG. 14 is a rear view of an embodiment of the current invention.

As shown in FIG. 14, to facilitate installation of the emergency lighting system, push-in fittings 1400 may be used to easily connect wires 1402 to the back of the emergency lighting system 102. To disconnect the wire 1402, a release button 1404 can be pressed and the wires 1402 can be removed.

Figure 15:
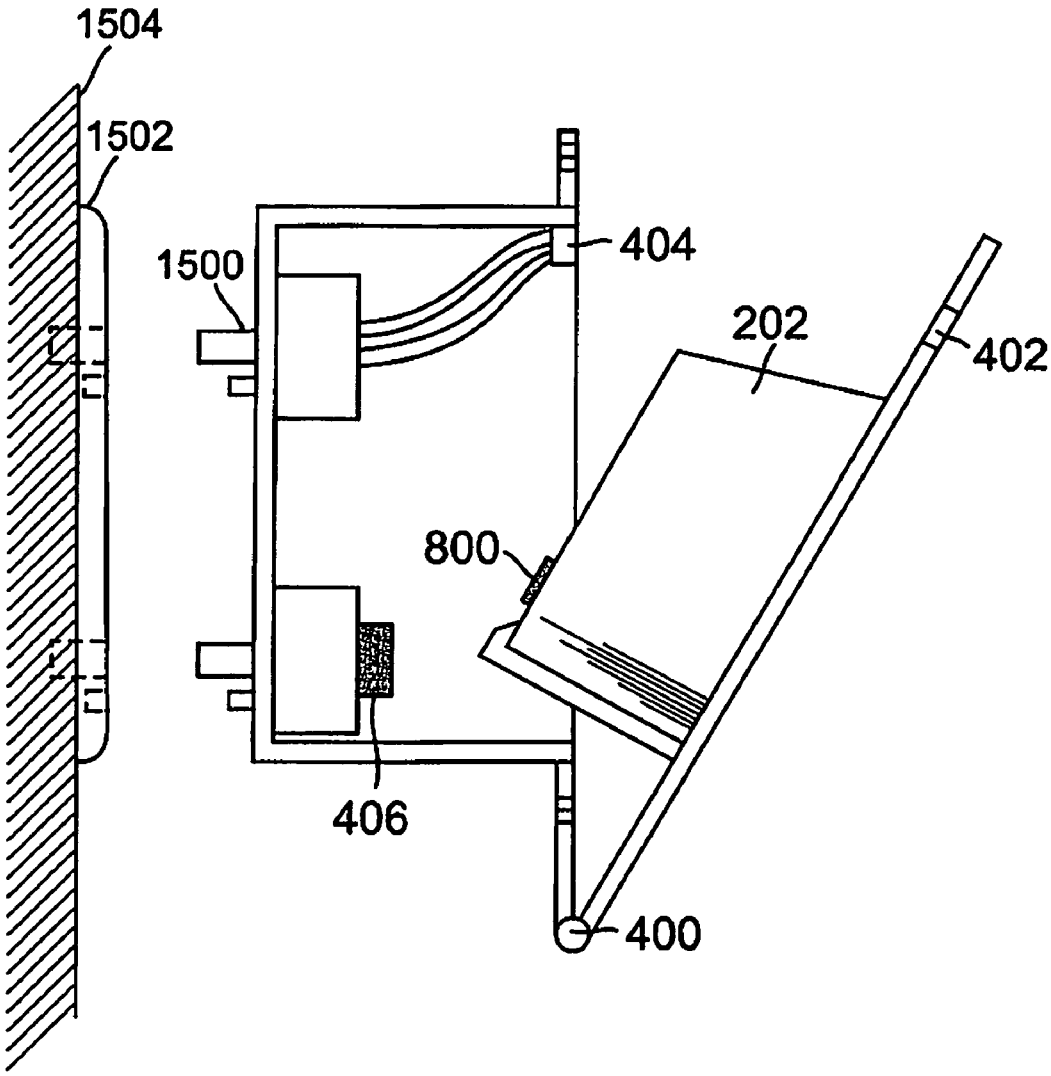
FIG. 15 is a side view of another embodiment of the current invention.

In some embodiments, the emergency lighting system 102 may be a "plug-in" style in which the emergency lighting system 102 plugs into an existing outlet 1502 as shown in FIG. 15. The emergency lighting system 102 may have outlet plugs 1500 on the back of the housing 104 that plug into an electrical outlet 1502 to power the system. To prevent loss of use of the electrical outlet, the cover 106 may also have an outlet 900 that feeds into the main outlet 1502 in the wall 1504.

Figure 11:
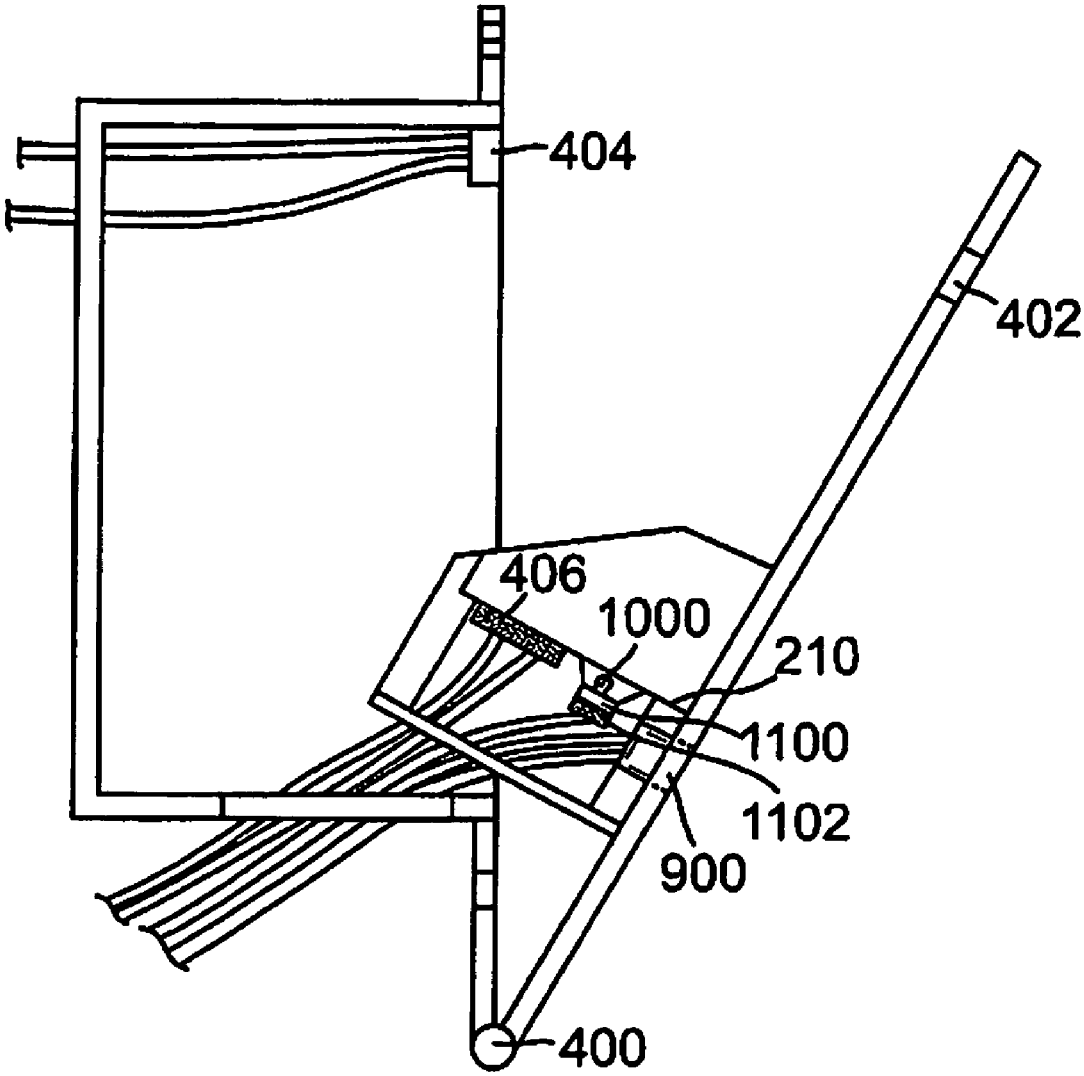
FIG. 11 is side view of the another embodiment of the current invention with one side wall removed for clarity only.

In some embodiments, as shown in FIGS. 9 and 11, the cover may further comprise an outlet 900 or an electrical outlet access orifice. The outlet 900 may be positioned anywhere on the cover 106 for easy access to plug in electrical devices. Preferably, the electrical outlet 900 is incorporated into the floor 210 as shown in FIG. 11.

In some embodiments, the emergency lighting system may be installed adjacent to an electrical outlet, such as above an electrical outlet. An electrical outlet access orifice may surround the electrical outlet so as to expose the electrical outlet. This allows the electrical outlet to be utilized. The electrical outlet orifice should be large enough, such that electrical plugs do not interfere with the deployment of the emergency lighting system 102. In other words, an electrical plug should not obstruct the cover 106 from opening.

In some embodiments, the emergency lighting system 102 further comprises a fixed light source 1000 that remains off under normal conditions and automatically turns on in response to a predetermined condition. The fixed light source 1000 may be located anywhere on the inside of the cover 106, outside of the cover 106, inside of the housing 104, or on the support 204. FIG. 11 shows one wall of the support 204 removed to show one possible arrangement of the battery recharging base 406, the fixed light source 1000, and the electrical outlet 900. The fixed light source 1000, like the removable light source 202 may remain off under normal conditions and automatically turn on in emergency situations. Alternatively, the fixed light source 1000 may be automatically turned on by the removal of the removable light source 202. The fixed light source 1000, however, is not removable from the housing or cover. This provides continuous lighting in a given area even after the light source 202 is removed by one of the residents.

As shown in FIG. 11, the fixed light source 1000 also comprises a battery 1100 and a battery recharging base 1102. Under normal conditions the battery recharging base 1102 receives power from the mains power supply to recharge the battery 1100. Under emergency conditions, when mains power is no longer available, the battery 1100 supplies power to the fixed light source 1000. In some embodiments, when the removable light source 202 is still in contact with its recharging base 406, power from the battery 1100 of the fixed light source 1000 is interrupted. When the removable light source 202 is removed from its charging base 406 the battery 1100 of the fixed light source 1000 is able to supply power to the fixed light source 1000. In other embodiments, simply cutting off the mains power to the recharging base 1102 allows the battery 1100 to power the fixed light source 1000. Thus, the predetermined conditions that turn on the fixed light source 1000 may be emergency situations or when the removable light source has been removed.

In some embodiments, the emergency lighting system comprises a plurality of light sources 202 that remain off under normal conditions but are automatically turned on under emergency situations. Each removable light source 202 may be stacked on top of the other, placed adjacent to each other, or otherwise efficiently arranged inside the housing 104. During an emergency situation when the emergency lighting system 102 is deployed the cover 106 opens and all of the removable light sources 202 turn on. A first resident may take the first removable light source 202 while the additional removable light sources 202 remain on inside the housing for subsequent residents to find and take as needed. In embodiments with a plurality of removable light sources 202 recharging bases 406 for each removable light source may be arranged either on the removable light sources 202 or along the walls of the support 204 so that each removable light source can be charged under normal conditions.

Figure 12:
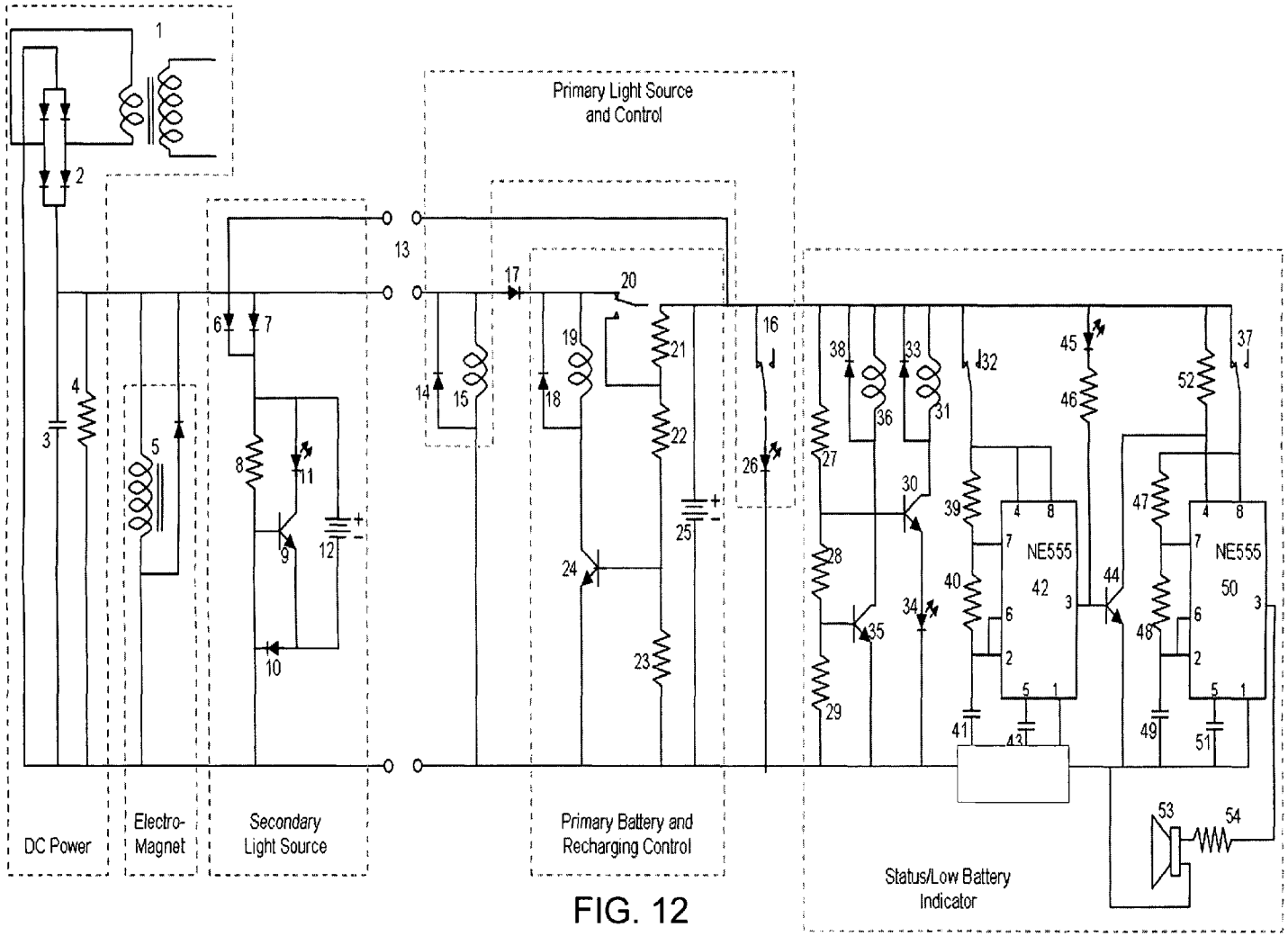
FIG. 12 is circuit diagram in accordance with an embodiment of the current invention.

Referring to the circuit diagram of FIG. 12, during normal operation, the transformer 1 steps wall AC current down to 15V AC. A full wave rectifier 2, together with smoothing capacitor 3 and bleeder resistor 4, provide the DC power for use throughout the rest of the unit. When wall power is available, the electromagnet 5 is energized, holding the cover 106 closed with the removable light source 202 inside the housing 104. The secondary light source battery 12 is trickle charged while transistor 9 is off because its base is at ground. With the transistor off, secondary light LED 11 remains off. In some embodiments, the capacitor 3 is sized large enough so that if wall power is lost, it will take approximately 1 to approximately 30 seconds to discharge. Preferably the capacitor 3 is sized large enough to take approximately 5 to approximately 15 seconds to discharge. This ensures that the device will not deploy during momentary power glitches.

With the removable primary light unit in place (connected through contacts 13), main power energizes relay coil 15, which keeps its corresponding single-pole double-throw ("SPDT") contact 16 in the open state. Thus, primary light LED 26 remains off while wall power is available.

Also housed in the removable light unit is the primary battery charge control. When the battery 25 is fully charged, the voltage divider created by resistors 21, 22 and 23 raises the base voltage of transistor 24 and turns the transistor on. With current flowing through the transistor, relay coil 19 energizes and switches contact 20 such that the battery 25 is disconnected from wall power, ceasing charging. This state of connection also bypasses resistor 21 in the voltage divider, raising the transistor 24 base voltage. When the battery voltage drops to a level where transistor 24 turns off, relay coil 19 becomes de-energized and relay contact 20 reconnects wall power, starting the charging process. This also puts resistor 21 back into the voltage divider, so that charging will continue until the full-charge voltage of the battery is reached.

The final section of the circuitry in the removable light unit is the status and low battery indicators. When normally charged, the voltage divider created by resistors 27, 28 and 29 will turn on transistors 30 and 35, energizing relay coils 31 and 36. This opens relay contacts 32 and 37 and disconnects the low battery indicator circuit. When transistor 30 is on the battery level is normal. As current flows through this transistor 30, a green LED 34 will turn on, indicating normal operation.

If, for some reason, the battery voltage drops to an abnormally low level, the base voltage of transistor 30 will drop and the transistor will turn off. Relay coil 31 will be de-energized and contact 32 will close. The circuit uses an NE555 42 in a stable mode operation. While the low battery condition exists, the NE555 42 output oscillates at a frequency and duty cycle set by the values of resistors 39 and 40 and capacitor 41. When the output (pin 3) of NE555 42 is low, the negative side of red (or any other color) LED 45 goes low, causing it to turn on and flash at the set frequency. In some embodiments, LED 45 may remain on and not flash at a set frequency.

If the voltage of the battery drops even further, the base voltage of transistor 35 will drop and the transistor will turn off. This will de-energize relay coil 36 and close contact 37, enabling the audible low battery alert. This part of the circuit uses another NE555 50, which generates the signal that will drive the speaker 52. Note that the output of NE555 42 is also connected to the base of transistor 44. As NE555 42 oscillates, the transistor will turn on and off at the set frequency and duty cycle. When the output is high, transistor 44 will turn on, pulling the reset pin (pin 4) of NE555 50 low, thereby disabling the audible alert. When the output is low, transistor 44 will turn off and the reset pin will be pulled high through resistor 52, enabling the audible alert. Therefore, when the battery voltage is extremely low, the red LED 45 will flash and the speaker 53 will sound in a synchronized manner. The frequency of the audible alert is set by resistors 47 and 48, and capacitor 49. In some embodiments, the audible alert or alarm may be a solid tone.

When wall power becomes unavailable (through a power outage, for example), the electromagnet 5 becomes de-energized and the unit housing pops out of the wall. Relay coil 15 is also de-energized and relay contact 16 returns to its normally closed position, allowing current to flow through primary light source LED 26. The primary light is now on. Diode 17 prevents current from the primary battery turning relay 15 back on. The battery recharging section will remain inactive while wall power is unavailable, although it will draw a small current through the voltage divider. The low battery indicator will operate normally.

In some embodiments, deployment of the emergency lighting system may be delayed in case there is a brief power interruption. When wall power becomes unavailable (through a power outage, for example), the charge in capacitor 3 begins to discharge. After about 1 to about 30 seconds, preferably about 5 to about 15 seconds, if wall power is not restored, the capacitor will completely discharge and battery powered operation will begin.

Figure 16:
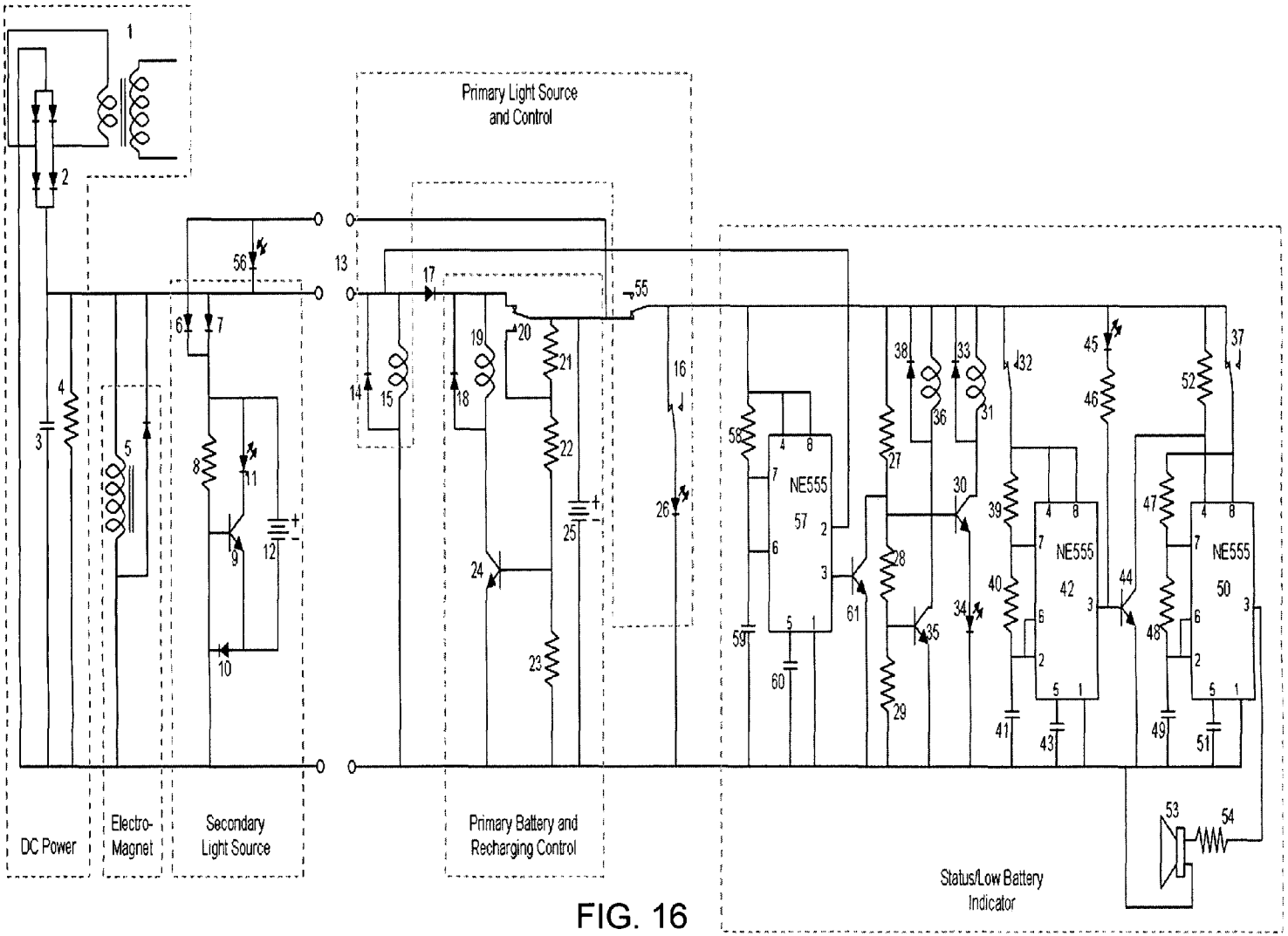
FIG. 16 is another circuit diagram in accordance with an embodiment of the current invention.

In some embodiments, the emergency lighting system may be designed not to deploy if sufficient ambient light is present. As shown in the circuit diagram in FIG. 16, if photodiode 56 detects the presence of visible light, it will route power from the primary battery to the electromagnet 5 and relay coil 15, preventing the unit from deploying and preventing the primary light source LED 26 from turning on.

If wall power is lost and the room is dark for more than about 1 second, preferably more than about 5 seconds, the electromagnet 5 will turn off and the unit will deploy from the wall. Relay coil 15 is also de-energized and relay contact 16 returns to its normally closed position, allowing current to flow through primary light source LED 26. The primary light turns on. Diode 17 prevents current from the primary battery turning relay 15 back on. The battery recharging section will remain inactive while wall power is unavailable, although it will draw a small current through the voltage divider. The low battery indicator will operate normally.

In some embodiments, the emergency lighting system may also emit an audible sound. As shown in the circuit diagram in FIG. 16, when the unit deploys from the wall, the drop in wall voltage triggers the input of NE555 57, which is operating in a monostable configuration. The NE555 57 will output a single pulse with a duration of about 1 second to about 60 seconds, preferably 30 seconds, which is determined by setting appropriate values of resistor 58 and capacitor 59. During this time, the output will go high, turning on transistor 61. When this transistor is on, the bases of transistors 30 and 35 will be pulled low and they will turn off. This will turn on the flashing red LED and audible alert of the low battery indicator circuit, providing an audible notification that the unit has deployed. After the predetermined period, the output of NE555 57 will return to low, the low battery indicator circuit will resume normal operation, and the audible alarm will turn off.

If the removable light unit is removed from the wall housing (with or without wall power available), the unit will operate in the same manner as when wall power in unavailable. The primary light will automatically turn on and recharging will not occur. If the detached unit is then used for some time and the batter voltage drops the low battery indicator will flash. In some embodiments, the removable light source has a manual switch 55 that can be used to turn the unit off and disable the low battery alarms when removed from the housing.

In some embodiments, the housing or the cover unit houses a secondary light source that turns on when wall power is unavailable and the primary light has been removed from the wall housing. If wall power is lost, no current flows to the secondary light source through diode 7. However, power is still available to the secondary light source from the primary battery through physical contact 13 and diode 6. Therefore, as long as the removable light unit is docked to the base and the primary battery is providing power, the secondary light will remain off. However, if wall power is lost and the removable light unit is removed, the secondary light source becomes active. With no other power available, current flows from secondary battery 12 through resistor 8 and raises the base voltage of transistor 9, turning it on. Diode 10 prevents any current from flowing back to the battery through that path, effectively rendering it open in this mode of operation. With the transistor on, LED 11 will turn on, generating light. If either wall power is restored or the removable light unit is returned to the base, the secondary light source will turn off and the secondary battery 12 will resume trickle charging.

The preferred normal and emergency conditions where this device would be applicable are when power is available and during power outages respectively. The emergency lighting system can be wired such that when power is available to a building or a home, the emergency lighting system 102 would be off and the power source 700 would be charged by the available power. During the power outage, the emergency lighting system 102 would deploy and the light source 202, powered by the power source 700, would automatically turn on and depending on the embodiment, the cover 106 would open automatically or be opened manually and the light source 202 would be presented for removal if necessary. When the power is restored, the light source 202 would automatically turn off and the power source 700 would begin charging again.

The emergency lighting system could further comprise a contact closure/relay type input on it in order for the lights to be controlled by an outside Home Automation system or lighting control system, such as a fire or burglar alarm system. This could be tied to all sorts of logic based situations. For example, this connection could provide a trigger to notify a home automation system that the lights have been deployed. The home automation system could then activate pre-programmed macros or sequences based on that condition. Some examples of these macros could be to shut down computer equipment, turn on back-up power to the building or any other safety related sequence. Utilizing the trigger connection, the lights could also notify a security or fire alarm system that the emergency lights have been deployed so that those systems could, in turn, notify the authorities or any outside agency or company that should know that there was a power loss. This connection could also be used to provide an accurate record of when the lights were deployed, which could be valuable information to an outside agency, such as the police or fire department The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

INDUSTRIAL APPLICABILITY

This invention may be industrially applied to the development, manufacture, and use of an emergency lighting system comprising a housing, a cover, and a removable light, wherein under normal conditions the cover remains closed and the removable light remains off but under emergency conditions, such as a power failure, the cover opens and the removable light automatically turns on. The removable light can then be removed and used like a normal flashlight. The removable light is powered by a rechargeable battery that is recharged under normal conditions.

What is claimed is:

1. An emergency lighting system comprising:

a. a housing;

b. a removable light source located inside the housing during a normal condition, wherein the removable light source is not fixed to the housing by electrical wires so as to be removable, the removable light source further comprising:

i) at least one power source, ii) wherein the removable light source remains off under the normal condition and the removable light source automatically turns on in response to an emergency condition;

c. a cover attached to the housing, the cover comprising a means for reversibly engaging the removable light source onto the cover for instant removal from and replacement onto the cover during the emergency condition;

d. a means for automatically deploying the cover from a closed position to an open position during the emergency condition to provide access to the removable light source; and e. a means for automatically retracting the cover back to the closed position.

2. The emergency lighting system of claim 1, further comprising a means for delaying the automatic deployment of the cover and the automatic turning on of the removable light source, wherein the cover is automatically deployed and the removable light source is automatically turned on when the emergency condition exists for longer than a predetermined period.

3. The emergency lighting system of claim 1, further comprising a light sensor, wherein the cover is automatically deployed and the removable light source is automatically turned on when the light sensor is deactivated.

4. The emergency lighting system of claim 1, further comprising an alarm.

5. The emergency lighting system of claim 1, further comprising mounting wings to secure the emergency lighting system in a wall.

6. The emergency lighting system of claim 1, further comprising an outlet plug on the housing to plug into an outlet.

7. The emergency lighting system of claim 6, further comprising a fixed light source located inside the emergency lighting system configured to turn on automatically in response to a predetermined condition.

8. The emergency lighting system of claim 1, further comprising a push-in fitting electrical connector.

9. An emergency lighting system comprising:

a. a housing;

b. a removable light source located inside the housing during a normal condition, wherein the removable light source is not fixed to the housing by electrical wires, the removable light source further comprising:

i) at least one power source, ii) wherein the removable light source remains off under the normal condition and the removable light source automatically turns on in response to an emergency condition;

c. a cover attached to the housing, wherein the cover is flat so as to inconspicuously blend in with a wall, the cover comprising a means for reversibly engaging the removable light source onto the cover for quick and easy removal from and replacement onto the cover without the use of tools; and d. a means for automatically retracting the cover back into a closed position.

10. The emergency lighting system of claim 9, further comprising a means for automatically deploying the cover during the emergency condition to provide access to the removable light source.

11. The emergency lighting system of claim 10, further comprising a means for delaying the automatic deployment of the cover and the automatic turning on of the removable light source, wherein the cover is automatically deployed and the removable light source is automatically turned on when the emergency condition exists for longer than a predetermined period.

12. The emergency lighting system of claim 10, further comprising a light sensor, wherein the cover is automatically deployed and the removable light source is automatically turned on when the light sensor is deactivated.

13. The emergency lighting system of claim 9, further comprising an alarm.

14. The emergency lighting system of claim 9, further comprising mounting wings to secure the emergency lighting system in a wall.

15. The emergency lighting system of claim 9, further comprising an outlet plug on the housing to plug into an outlet.

16. The emergency lighting system of claim 15, further comprising a fixed light source located inside the emergency lighting system configured to turn on automatically in response to a predetermined condition.

17. The emergency lighting system of claim 9, further comprising a push-in fitting electrical connector.

18. A method of facilitating escape from a building under an emergency condition, comprising: providing an emergency lighting system that automatically deploys in response to the emergency condition, the emergency lighting system comprising a housing, a removable light source inside the housing, and a flat cover removably attached to the housing and inconspicuously camouflaged within a wall, wherein the automatic deployment comprises the light source automatically illuminating an area adjacent to the emergency lighting system in response to the emergency condition wherein the removable light source is not fixed to the housing by electrical wires, and wherein the cover comprises a means for reversibly engaging the removable light source onto the cover for quick and easy removal from and replacement onto the cover without the use of any tools.

19. The method of claim 18, wherein the automatic deployment further comprises automatically releasing the flat cover from the housing in response to the emergency condition to make the removable light accessible.

* * * * *